US006402406B1

(12) United States Patent
Sasaki et al.

(10) Patent No.: US 6,402,406 B1
(45) Date of Patent: Jun. 11, 2002

(54) RECORDING APPARATUS AND METHOD OF REMOVING FOREIGN OBJECTS THEREFOR

(75) Inventors: Yoshiharu Sasaki; Hironobu Satou, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/507,679

(22) Filed: Feb. 22, 2000

(30) Foreign Application Priority Data

Feb. 24, 1999 (JP) ..... 11-046542

(51) Int. Cl.[7] ..... B41F 35/00

(52) U.S. Cl. ..... 400/701; 400/702; 101/423; 101/425

(58) Field of Search ..... 400/701, 702; 101/163, 423, 425; 15/3, 100, 101, 102, 103, 103.5, 256.5, 256.51, 256.52, 104.002

(56) References Cited

U.S. PATENT DOCUMENTS 5,349,714 A * 9/1994 Korbonski et al. ..... 15/3
5,611,281 A * 3/1997 Corrado et al. ..... 101/425
6,027,850 A * 2/2000 Kawakami et al. ..... 430/201

FOREIGN PATENT DOCUMENTS

| | | | |
|---|---|---|---|
| JP | 58-89532 A * | 5/1983 | |
| JP | 4-296594 | 10/1992 | ..... B41M/5/40 |
| JP | 4-327982 | 11/1992 | ..... B41M/5/26 |
| JP | 4-327983 | 11/1992 | ..... B41M/5/26 |
| JP | 7-290731 | 11/1995 | ..... B41J/2/32 |
| JP | 10-186982 A * | 7/1998 | |
| JP | 11-20977 A * | 1/1999 | |

* cited by examiner

*Primary Examiner*—Andrew H. Hirshfeld
*Assistant Examiner*—Minh H. Chau
(74) *Attorney, Agent, or Firm*—Sughrue Mion, PLLC

(57) ABSTRACT

A recording apparatus removes foreign objects adhering to a recording medium over a long period of time, so that images having no defects caused by foreign objects are obtained over a long period of time. The recording apparatus includes a recording medium supply section, a recording medium conveyance section, a record medium cutting section, and a recording section. An adhesive rubber roller containing $TiO_x$ (titanium oxide) and a hydrocarbon compound, having a functional group of C—O or Si—O and not containing Ba (barium), is used in at least one of the recording medium supply section, recording medium conveyance section, recording medium cutting section and recording section.

14 Claims, 12 Drawing Sheets

REMARK : AT LEAST ONE OF THE UPPER AND THE LOWER CONVEYANCE ROLLER IS AN ADHESIVE RUBBER ROLLER CONTAINING TiOx AND HYDROCARBON COMPOUND HAVING A FUNCTIONAL GROUP OF C – O OR Si – O

REMARK : AT LEAST ONE OF THE UPPER AND THE LOWER CONVEYANCE ROLLER IS AN ADHESIVE RUBBER ROLLER CONTAINING TiOx AND HYDROCARBON COMPOUND HAVING A FUNCTIONAL GROUP OF C – O OR Si – O

REMARK : AT LEAST ONE OF THE UPPER 1 AND THE LOWER CONVEYANCE ROLLER 1 AND AT LEAST ONE OF THE UPPER 2 AND THE LOWER CONVEYANCE ROLLER 2 ARE ADHESIVE RUBBER ROLLERS CONTAINING TiOx AND HYDROCARBON COMPOUND HAVING A FUNCTIONAL GROUP OF C – O OR Si – O

REMARK : AT LEAST ONE OF THE UPPER AND THE LOWER CONVEYANCE ROLLER BEFORE CUTTING AND AT LEAST ONE OF THE UPPER AND THE LOWER CONVEYANCE ROLLER AFTER CUTTING ARE ADHESIVE RUBBER ROLLERS CONTAINING TiOx AND HYDROCARBON COMPOUND HAVING A FUNCTIONAL GROUP OF C – O OR Si – O

REMARK : THE ADHESIVE ROLLER CONTAINS TiOx AND HYDROCARBON COMPOUND HAVING A FUNCTIONAL GROUP OF C – O OR Si – O

RECORDING APPARATUS AND METHOD OF REMOVING FOREIGN OBJECTS THEREFOR

BACKGROUND OF THE INVENTION

1. Field of the Invention

The present invention relates to a recording apparatus having an adhesive roller for removing foreign objects from a recording medium, and the recording apparatus records information such as images or characters on the recording medium. Especially, the recording apparatus records information such as color images and characters with color toners of K (black), C (cyan), M (magenta) and Y (yellow).

2. Description of the Related Art

In a conventional recording apparatus of the above type, image recording is conducted when laser beams are irradiated from an optical head onto a recording medium fixed on a rotary drum used for recording. In this case, a toner sheet having a toner layer, which is formed on a permeable support, capable of conducting heat-transfer, and an image receiving sheet are used as a recording medium, and the toner sheet is heated according to image data to be recorded, so that a heated portion or a non-heated portion of the toner layer is transferred onto the image receiving sheet. In this way, an image is formed on the image receiving sheet.

Specifically, image recording is conducted as follows. A toner sheet is used, on which a heat-fusible, heat adhesive or sublimate coloring material layer (light-heat conversion+ toner layer) is formed. At least at a recording position, the toner sheet is put on the image receiving sheet, that is, the toner sheet is closely contacted with the image receiving sheet, and the toner layer is heated according to image data by laser beams from a reverse side of the toner sheet or the image receiving sheet, so that a latent image is formed on the toner layer. After that, the toner sheet and the image receiving sheet are separated from each other. In this way, a portion of the toner layer, which has been exposed to laser beams, is transferred onto the image receiving layer, so that the image can be transferred onto the image receiving sheet.

First, explanation will be made referring to FIG. 15 which is a perspective view of a primary portion of the recording apparatus used for the present invention.

In FIG. 15, reference numeral 1 is an optical head having a plurality of lasers, and the respective lasers are turned on and off for modulation according to data to be recorded and the modulated laser beams are irradiated, and the optical head 1 is capable of moving in a direction of one dimension.

Reference numeral 2 is a rotary drum for recording on which a recording medium is attached, and this rotary drum is rotated at high speed.

Reference numeral 3 is a recording medium, the structure of which is different according to the use, that is, reference numeral 3 is a recording medium for CTP (computer to plate), DDCP (direct digital color proofer) or lease.

Reference numeral 4 is a movable stage or an auxiliary scanning stage, on which the optical head 1 is mounted, capable of moving on a rail in parallel with the recording medium 3 attached onto the rotary drum 2 for recording. While the movable stage 4 is moving, the recording medium 3 is irradiated with laser beams emitted from the optical head 1, so that an image can be recorded. The moving direction of the optical head 1 corresponds to the auxiliary scanning direction in the image formation, and the rotary direction of the rotary drum 2 for recording corresponds to the primary scanning direction.

Next, referring to FIG. 16, the structure of the recording medium 3 attached to this recording apparatus will be explained below. Also, referring to FIG. 17, the specific procedure of image recording will be explained below.

FIG. 16 is a view showing an image receiving sheet 31 and a toner sheet 32 composing the recording medium 3 shown in FIG. 15. In the actual recording process, image recording is conducted on the recording medium 3 by a heat transfer sheet composing the recording medium shown in FIG. 16. The toner sheet 32 is composed of "a support, light-heat conversion layer and toner layer" which are arranged in this order from the laser beam irradiating side. On the other hand, the image receiving layer 31 is composed of "an image receiving layer, cushion layer and support" which are arranged in this order from the toner sheet 32 side. The toner sheet 32 is put on the image receiving sheet 31 in such a manner that the toner layer of the toner sheet 32 is directed to the image receiving sheet 31 side, and laser beams are irradiated onto the toner sheet 32 and the image receiving sheet 31. Then, the irradiated toner layer is heated and transferred onto the image receiving layer.

The support of the toner sheet 32 shown in FIG. 16 is made of PET (polyethylene terephthalate), TAC (triacetyl cellulose) or PEN (polyethylene naphthalate) through which laser beams can be transmitted. For the light-heat conversion layer, carbon, black substance, infrared ray absorbing pigment and specific wave-length absorbing substance, which can effectively convert laser beam energy into heat, are used. On the toner sheet, there are provided toner sheets of K (black), C (cyan), M (magenta) and Y (yellow). In some cases, there are provided toner sheets of gold, silver, light-brown, gray, green and orange. Characteristics of heating and recording are different with respect to these toner sheets of various colors.

The image receiving layer of the image receiving sheet 31 receives toner to be transferred. The cushion layer functions to absorb steps when a plurality of toner layers are put on each other. In this connection, the above structure is different according to the use. The detail of the toner sheet and image receiving sheet to be used are described in Japanese Unexamined Patent Publication No. JP-A-4-296594, JP-A-4-327982 and JP-A-4-327983 which are applied by the present applicant.

FIG. 17 is a process drawing of recording which shows each recording process carried out for each color of K, C, M and Y. Each recording process is composed of a laminate process, a laser beam recording process in which recording is conducted by laser beams according to color data, and a process in which the toner sheet 32 is peeled off from the image receiving sheet 31.

Process (1)

The image receiving sheet is wound round the rotary drum 2 for recording (FIG. 17*a*).

Process (2)

First, in order to execute a process of color K, the toner sheet of color K is wound round the image receiving sheet (FIG. 17*b*).

Process (3)

When necessary, the toner sheet of color K is laminated on the image receiving sheet by the rotary roller, one portion of which is shown in the drawing (FIG. 17*c*).

Process (4)

Laser beams are irradiated according to image and character data of color K, so that recording is conducted (FIG. 17*d*).

Process (5)

The toner sheet of color K is peeled off from the image receiving sheet. In this way, the process of color K is completed (FIG. 17*e*).

Process (6)

In the same manner as that of the process of color K, the process of color C is executed. The toner sheet of color C is wound round the image receiving sheet.

Process (7)

Under certain circumstances, the toner sheet of color C is laminated.

Process (8)

Recording is conducted by laser beams according to data of color C.

Process (9)

Finally, the toner sheet of color C is peeled off from the image receiving sheet. In this way, the process of color C is completed.

Process (10)

Successively, in the same manner, the process of color M is executed. The toner sheet of color M is wound round the image receiving sheet.

Process (11)

Under certain circumstances, lamination is carried out.

Process (12)

Recording is conducted by laser beams according to data of color M.

Process (13)

The toner sheet of color M is peeled off from the image receiving sheet. In this way, the process of color M is completed.

Process (14)

Finally, in the same manner, the process of color Y is executed. The toner sheet of color Y is wound round the image receiving sheet.

Process (15)

Under certain circumstances, the toner sheet of color Y is laminated.

Process (16)

Recording is conducted by laser beams according to data of color Y.

Process (17)

Finally, the toner sheet of color Y is peeled off from the image receiving sheet. In this way, the process of color Y is completed.

Process (18)

Due to the foregoing, four colors of K, C, M and Y are appropriately put on the image receiving sheet, and a necessary color image can be formed (FIG. 17*f*).

In the above recording apparatus, color image recording of colors K, C, M and Y is conducted as follows. As shown in the arrangement view of FIG. 16, there is provided a recording medium 3 composed in such a manner that a toner sheet containing a heat-fusible, heat adhesive or sublimate toner is tightly put on the image receiving sheet. This recording medium 3 is fixed onto the rotary drum 2 for recording and irradiated with laser beams emitted from the optical head 1.

FIG. 18 is an overall arrangement view of the recording apparatus used in the present invention. Referring to FIG. 18, the summary of the recording apparatus is described below. In this connection, FIG. 18 is related to the application of the present applicant, the detail of which are described in Japanese Unexamined Patent Publication No. 07-290731.

In the drawing, reference numeral 30 is the recording apparatus used in the present invention. This recording apparatus 30 is provided for forming a full color image. This recording apparatus 30 includes: a supply section 32 for supplying a toner sheet 10 and an image receiving sheet 12; a rotary drum 34 used as a holding member for holding the toner sheet 10 at the image recording position and also used as a conveyance means for conveying the toner sheet 10; a photosensitive material fixing and releasing mechanism 36 arranged on the rotary drum 34; a laminate mechanism 38 arranged on an outer circumference of the rotary drum 34; an exposing means 40; a separating means 42; a sheet feed section 44; a laminate section 46; a fixing section 48; a separating section 50; a tray section 52; and a control section 84.

In the above recording apparatus 30, first, the image receiving sheet 12 is supplied from the supply section 32 onto the rotary drum 34 and fixed by the photosensitive material fixing and releasing mechanism 36. Next, the toner sheet 10 is supplied onto the rotary drum 34 from the photosensitive material supply section 32 and laminated on the image receiving sheet 12 by the laminate mechanism 38.

After that, the toner sheet 10 is exposed to and heated by the laser beams sent from the optical head 24 which is controlled by an image signal sent from the control section 84. In this way, a latent image is formed on the toner sheet 10.

Successively, the toner sheet 10 is peeled off from the image receiving sheet 12, which is fixed onto the rotary drum 34, by the separating mechanism 42. The latent image on the toner sheet 10 is transferred onto the image receiving sheet 12 and developed. In this way, an image is formed on the image receiving sheet 12.

The above operation is repeated with respect to three to four colors, so that a color image is formed on the image receiving sheet 12. After the formation of the color image on the image receiving sheet 12, this image receiving sheet 12 and a main sheet 14, which has been supplied from the sheet supply section 44, are laminated in the laminate section 46. Then, the image receiving layer 16 on the image receiving sheet 12 is optically fixed by the fixing section 48 and peeled off by the separating section 50. The main sheet on which the full color image is formed is discharged onto the tray 52*a*, and the thus used image receiving sheet 12 is discharged onto a stacker 52*b* for used sheets. In this way, a hard copy of the full color image can be obtained.

The supply section 32 includes: a station 53 for holding a roll-shaped image receiving sheet 12 and a plurality of roller-shaped toner sheets 10 such standard toner sheets of Y, M, C and K or specific color sheets used in the field of printing; a pair of drawing rollers 54 for drawing the roll-shaped toner sheet 10 and the image receiving sheet 12; a cutter 55 for cutting the toner sheets 10 and others drawn out from the station 53 by the drawing roller 54 by a predetermined length; a pair of rollers 56 for conveying the toner sheet 10 and others when they are interposed between the rollers 56; and a guide 57 for guiding the toner sheet and others and also guiding ends of the toner sheet and others to the fixing and releasing mechanism 36 attached onto the rotary drum 34.

First, the image receiving sheet 12 is supplied to the rotary drum 34. A leading end of the image receiving sheet 12 is fixed by a clamp of the fixing and releasing mechanism 36.

Then, the image receiving sheet 12 is wound on an outer circumference of the rotary drum 34 by the rotation of the rotary drum 34 in the direction of an arrow shown at the center of the drawing. A trailing end of the image receiving sheet 12 is also fixed by a clamp of the fixing and releasing mechanism 36. In this case, it is preferable that at least one of the leading end fixing section and the trailing end fixing section of the fixing and releasing means 36 for fixing and releasing the toner sheet 10 is capable of moving on the outer circumference of the rotary drum 34 so that the toner sheets 10 of various lengths can be fixed by the fixing section.

Next, the toner sheet 10 conveyed from the supply section 32 is laminated and wound on the image receiving sheet 12 which has been wound on the outer circumference of the rotary drum 34. The toner sheet 10 is laminated on the image receiving sheet 12 by a laminate mechanism 38 including: a laminate roller 58 into which a heater may be incorporated; an arm 59 for rotating the laminate roller 58 round a fulcrum 59*a* so that the laminate roller 58 can be contacted with the outer circumference of the rotary drum 34; and a pushing means for pushing the laminate roller 58 against the outer circumference of the drum by a predetermined pushing force.

The image receiving sheet and the toner sheet may be fixed onto the rotary drum by a vacuum suction mechanism or an electrostatic suction mechanism.

After the image receiving sheet 12 and the toner sheet 10 have been laminated and fixed onto the rotary drum 34, the toner sheet 10 is exposed to and heated by optical beam L emitted from the exposure means 40 from the reverse side (the support 18 side), so that a latent image can be formed on the toner layer 22.

The exposure means 40 includes: a modulation means; an optical head 24 composed of a light source for emitting a beam of light of high energy density and an image formation lens for adjusting a diameter of a light beam spot; and an auxiliary scanning means 61 for conducting auxiliary scanning by moving the beam of light in the auxiliary scanning direction when the optical head 24 is moved in the axial direction of the rotary drum 34. In this case, the auxiliary scanning direction 61 corresponds to the moving stage 4 shown in FIG. 15.

On the other hand, the primary scanning of a beam of light conducted on the toner sheet 10 is made by the rotation of the rotary drum 34 in the direction of arrow y, that is, the conveyance of the toner sheet 10 (the image receiving sheet 12) is made by the rotation of the rotary drum 34 in the direction of arrow y. In the recording apparatus 30 shown in the drawing, the toner sheet 10 is two-dimensionally scanned by light beam L in the same manner as that of the drum scanner.

In the above conventional recording apparatus, an adhesive roller is used in the recording medium conveyance system (A), and an adhesive roller is used in the recording section (B).

The reason why (A) the adhesive roller is used in the recording medium conveyance system is to prevent the formation of a defective image in the main sheet transfer process conducted successively, by removing foreign objects described in the following items (1) to (3). That is, the foreign objects are removed as follows.

(1) Foreign objects adhering to a recording medium are removed.

(2) Foreign objects adhering to a recording medium in a recording medium path in the process of conveyance are removed.

(3) When a continuous recording medium is cut by a cutter section, chips are generated from the recording sheet and adhering to the recording medium. Thus generated chips are removed.

FIG. 1 is a view showing a case described in the above item (1).

The devices illustrated in FIG. 1 correspond to the station 53 for holding a roller-shaped image receiving sheet 12 and a plurality of roller-shaped toner sheets 10 illustrated in FIG. 18 and also correspond to a pair of drawing rollers 54 for drawing the roller-shaped toner sheet 10 the image receiving sheet 12 illustrated in FIG. 18. In the above structure, at least one of the upper and the lower conveyance roller is an adhesive rubber roller. Accordingly, foreign objects adhering onto the recording medium conveyed in the direction of an arrow are removed while they are passing through between the upper and the lower conveyance roller, at least one of which is an adhesive roller.

FIG. 2 is a view showing a case described in the above item (2) in which foreign objects adhering to a recording medium in the recording medium conveyance path in the process of conveyance are removed.

In this case, it possible to consider the following three cases in which foreign objects adhering to the conveyance guide plate are adhering to the recording medium.

1) While a recording medium is being conveyed, it is bent. Due to the foregoing, the recording medium comes into contact with the conveyance guide plate, and foreign objects on the conveyance guide plate adhere to the recording medium.

2) By an electrostatic force generated by the recording medium which has been electrically charged, foreign objects on the conveyance guide plate are attracted by the recording medium, so that the foreign objects adheres to the recording medium.

3) A recording medium is attracted to the conveyance guide plate by the electrostatic force generated by the electrical charging of the recording medium, so that the foreign objects on the conveyance guide adheres to the recording medium.

Referring to FIG. 18, the above circumstances occur in the regions of the guide 57 to guide the toner sheet 10 onto the rotary drum 34 and the conveyance roller 56.

Therefore, at least one of the upper 1 and the lower conveyance roller 2 used for the conveyance system is composed of an adhesive roller. Accordingly, foreign objects adhering to the recording medium conveyed in the direction of the arrow are removed while the recording medium is being conveyed between the upper and the lower conveyance roller which are respectively composed of adhesive rollers.

According to the above item (3), when a continuous recording medium is cut by the cutter section into a sheet-shape, chips are generated from the recording sheet and adheres to the recording medium.

FIG. 3 is a view showing a case in which the thus attached chips are removed from the recording medium. The recording medium is conveyed by the upper and the lower conveyance roller before it is cut. Since at least one of the conveyance rollers is an adhesive rubber roller as shown in FIG. 2, foreign objects are removed from the recording medium before the recording medium is cut by a rotary blade. While the recording medium is being cut by the rotary blade, chips are generated from the recording medium and attached to the recording medium. FIG. 3 shows these circumstances. Referring to FIG. 18, the above circumstances occur in the regions of the cutter 55 to cut the toner sheet 10, which has been drawn out from the station 53 by the drawing roller 54, and the pair of conveyance rollers 56 to convey the toner sheet 10 and others. Therefore, at least one of the upper and the lower conveyance roller used after cutting is an adhesive rubber roller. Accordingly, foreign objects adhering to the recording medium conveyed in the direction of the arrow are removed while the recording medium is passing between the upper and the lower conveyance roller. The reason why the adhesive roller is used in the recording section (B) described before is that the foreign objects described in items (1) to (3) are removed so that the occurrence of a defective image can be prevented in the next main sheet transfer process. The detail are described as follows.

(1) Foreign objects adhering to the recording drum are removed.

(2) While the recording medium is being conveyed to the recording drum, or while the recording medium is being conveyed out from the recording drum, foreign objects attaching onto a surface of the recording medium are removed.

(3) Foreign objects adhering onto a surface of the recording medium which has been set on the recording drum are removed.

FIG. 3 shows a case of the above item (1) in which foreign objects adhering to the recording drum are removed.

As shown in the drawing, foreign objects attached onto the recording drum rotating in the direction of the arrow are removed by the adhesive roller, which is arranged in such a manner that it comes into contact with the recording drum, while the recording medium is passing through the adhesive roller.

FIG. 5 shows a case of the above item (2) in which while the recording medium is being conveyed to the recording drum, foreign objects adhering onto a surface of the recording medium are removed. In the drawing, foreign objects attached onto the recording medium conveyed in the direction of the arrow are removed by the adhesive roller which is arranged in such a manner that it comes into contact with the recording drum while the recording medium is passing through the adhesive roller.

FIGS. 6 and 7 show a case of the above item (2) in which while the recording medium is being conveyed out from the recording drum, foreign objects adhering onto a surface of the recording medium are removed. FIG. 6 is a view showing a case in which the recording medium is conveyed to left with respect to the rotary drum, and FIG. 7 is a view showing a case in which the recording medium is conveyed to right with respect to the rotary drum. In both drawings, foreign objects adhering onto the recording medium conveyed in the direction of the arrow are removed by the adhesive roller coming into contact with the recording drum while the recording medium is passing through the adhesive roller.

FIGS. 8 and 9 are views showing a case of the above item (3) in which foreign objects attached onto the recording medium during recording are removed. FIG. 8 is a view showing a case in which one sheet of recording medium (for example, one sheet of image receiving sheet) is conveyed on the rotary drum rotating in the direction of the arrow. FIG. 9 is a view showing a case in which two sheets of recording mediums (for example, one sheet of image receiving sheet and one sheet of toner sheet) are conveyed on the rotary drum rotating in the direction of the arrow. In both drawings, for example, foreign objects adhering onto the recording medium on the recording drum rotating in the direction of the arrow are removed by the adhesive roller while the recording medium is passing through the adhesive roller.

Referring to FIG. 18, the above circumstances occur in the region of the rotary drum 34 and also in the region before and after the rotary drum 34.

However, adhesive forces of the adhesive rubber rollers used in the above conveyance system (shown in FIGS. 1 to 3) and the recording section (shown in FIGS. 4 to 9) tend to decrease by a lapse of time. Therefore, when about 2 to 3 months have passed after the adhesive rubber rollers were manufactured, capacities of the adhesive rubber rollers to remove foreign objects from the recording mediums are deteriorated. As a result, images are not recorded in some portions of the recording medium, that is, defective images are formed.

The present invention has been accomplished to solve the above problems. It is an object of the present invention to provide an image recording apparatus characterized in that: foreign objects adhering onto a recording medium can be removed over a long period of time by using an adhesive rubber roller, the adhesive force of rubber of which is seldom changed with time, so that images having no defects can be obtained over a long period of time; and it is unnecessary to conduct maintenance on the recording apparatus over a long period of time.

SUMMARY OF THE INVENTION

In order to accomplish the above object, the invention described in claim 1 provides a recording apparatus comprising: a recording medium supply section; a recording medium conveyance section; a recording medium cutting section; and a recording section, wherein an adhesive rubber roller containing $TiO_x$ (titanium oxide) is used in at least one of said sections.

The invention described in a second aspect provides a recording apparatus comprising: a recording medium supply section; a recording medium conveyance section; a recording medium cutting section; and a recording section, wherein an adhesive rubber roller containing $TiO_x$ (titanium oxide) and not containing Ba (barium) is used in at least one of said sections.

The invention described in a third aspect provides a recording apparatus comprising: a recording medium supply section; a recording medium conveyance section; a recording medium cutting section; and a recording section, wherein an adhesive rubber roller containing hydrocarbon compound having a functional group of C—O or Si—O is used in at least one of said sections.

The invention described in a fourth aspect provides a recording apparatus comprising: a recording medium supply section; a recording medium conveyance section; a recording medium cutting section; and a recording section, wherein an adhesive rubber roller containing $TiO_x$ (titanium oxide) and hydrocarbon compound having a functional group of C—O or Si—O is used in at least one of said sections.

The invention described in a fifth aspect provides a recording apparatus comprising: a recording medium supply section; a recording medium conveyance section; a recording medium cutting section; and a recording section, wherein an adhesive rubber roller containing $TiO_x$ (titanium oxide) and hydrocarbon compound having a functional group of C—O or Si—O and not containing Ba (barium) is used in at least one of said sections.

The invention described in a sixth aspect provides a method of removing foreign objects applied to a recording apparatus having a recording medium supply section, a recording medium conveyance section, a recording medium cutting section and a recording section, comprising the step of removing foreign objects from a surface of the recording medium or the inside of the recording apparatus when an adhesive rubber roller containing $TiO_x$ (titanium oxide) is used in at least one of said sections.

The invention described in a seventh aspect provides a method of removing foreign objects applied to a recording apparatus having a recording medium supply section, a recording medium conveyance section, a recording medium cutting section and a recording section, comprising the step of removing foreign objects from a surface of the recording medium or the inside of the recording apparatus when an adhesive rubber roller containing $TiO_x$ (titanium oxide) and not containing Ba (barium) is used in at least one of said sections.

The invention described in a eighth aspect provides a method of removing foreign objects applied to a recording apparatus having a recording medium supply section, a recording medium conveyance section, a recording medium cutting section and a recording section, comprising the step of removing foreign objects from a surface of the recording medium or the inside of the recording apparatus when an adhesive rubber roller containing hydrocarbon compound having a functional group of C—O or Si—O is used in at least one of said sections.

The invention described in a ninth aspect provides a method of removing foreign objects applied to a recording apparatus having a recording medium supply section, a recording medium conveyance section, a recording medium cutting section and a recording section, comprising the step of removing foreign objects from a surface of the recording medium or the inside of the recording apparatus when an adhesive rubber roller containing $TiO_x$ (titanium oxide) and hydrocarbon compound having a functional group of C—O or Si—O is used in at least one of said sections.

The invention described in a tenth aspect provides a method of removing foreign objects applied to a recording apparatus having a recording medium supply section, a recording medium conveyance section, a recording medium cutting section and a recording section, comprising the step of removing foreign objects from a surface of the recording medium or the inside of the recording apparatus when an adhesive rubber roller containing $TiO_x$ (titanium oxide) and hydrocarbon compound having a functional group of C—O or Si—O and not containing Ba (barium) is used in at least one of said sections.

The invention described in a eleventh aspect provides a recording apparatus according to one of claims 1 to 5, wherein high speed scanning (primary scanning) is conducted by the rotation of the rotary drum and low speed scanning (auxiliary scanning) is conducted by the movement of an optical head in the axial direction of the rotary drum.

The invention described in a twelfth aspect provides a recording apparatus according to one of claims 6 to 10, wherein high speed scanning (primary scanning) is conducted by the rotation of a rotary drum and low speed scanning (auxiliary scanning) is conducted by the movement of an optical head in the axial direction of the rotary drum.

THE MOST PREFERRED EMBODIMENT

Referring to FIGS. 10 to 13, an embodiment of the present invention will be explained below.

Figure 10:
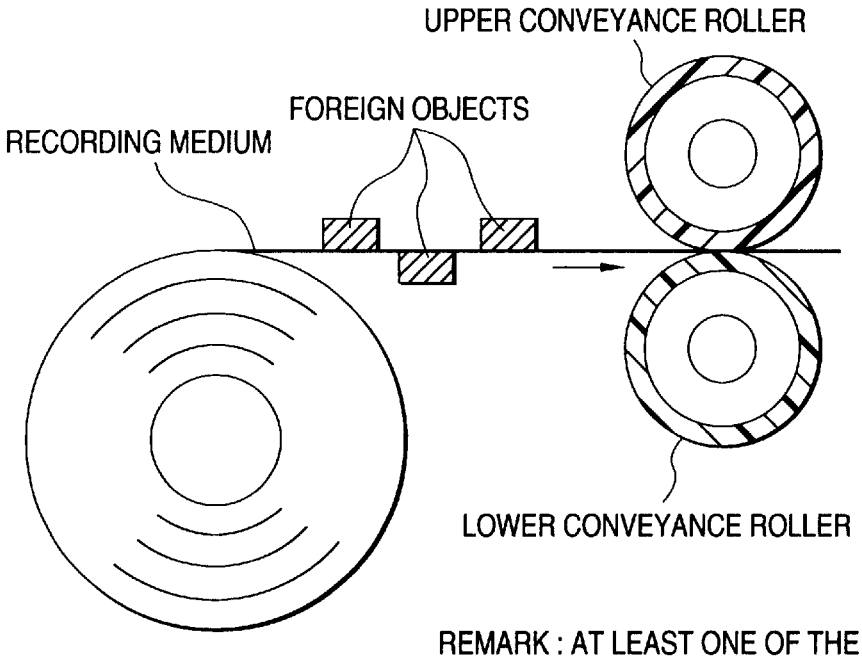
FIG. 10 is a schematic illustration showing a recording medium supply section which is one of the specific sections of a recording apparatus to which an adhesive roller of a first embodiment of the present invention can be applied.

FIG. 10 is a schematic illustration showing a case in which foreign objects adhering to a recording medium in a recording medium supply section, which is one of the sections of a recording apparatus to which an adhesive roller of the first embodiment of the present invention is applied, are removed.

In the drawing, at least one of the upper conveyance roller and the lower conveyance roller is composed of an adhesive rubber roller, the composition of which is prescribed by the present invention. That is, the adhesive rubber roller contains $TiO_x$ (titanium oxide) and/or hydrocarbon compound having a functional group of C—O or Si—O and does not contain Ba (barium).

Therefore, according to the present invention, it is possible to remove foreign objects adhering to a recording medium over a long period of time while the recording medium is passing between the upper and the lower conveyance rollers.

Figure 11:
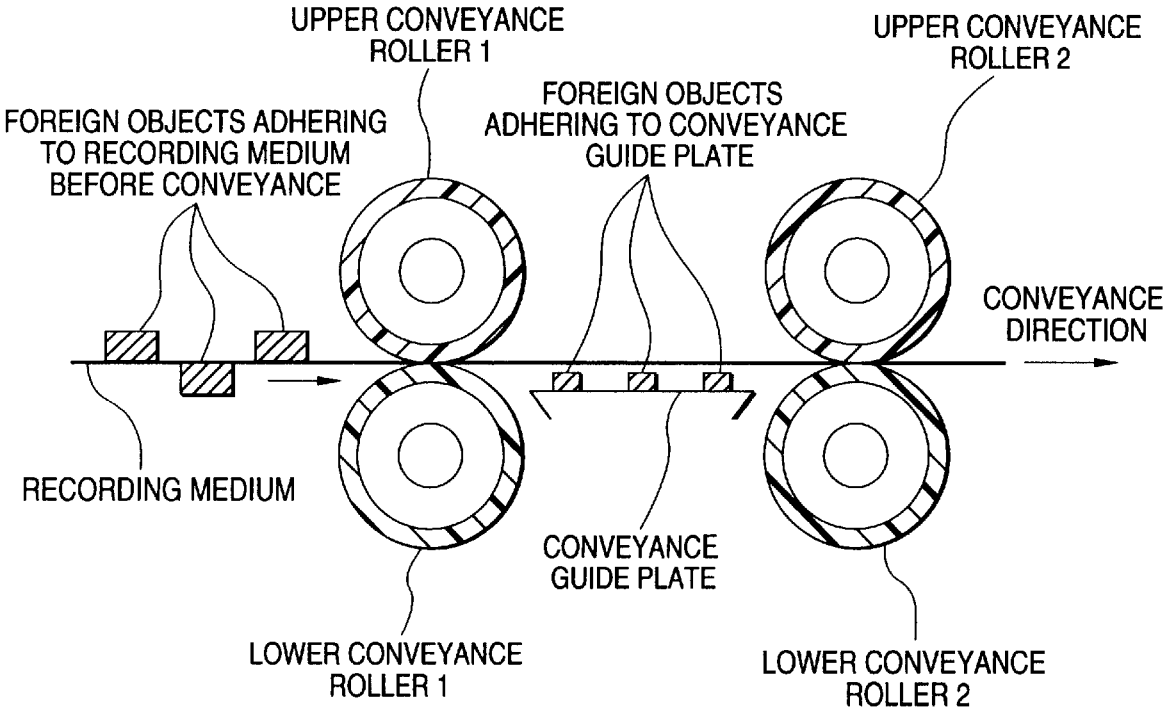
FIG. 11 is a schematic illustration showing a recording medium conveyance section which is one of the specific sections of a recording apparatus to which an adhesive roller of a second embodiment of the present invention can be applied.
Figure 12:
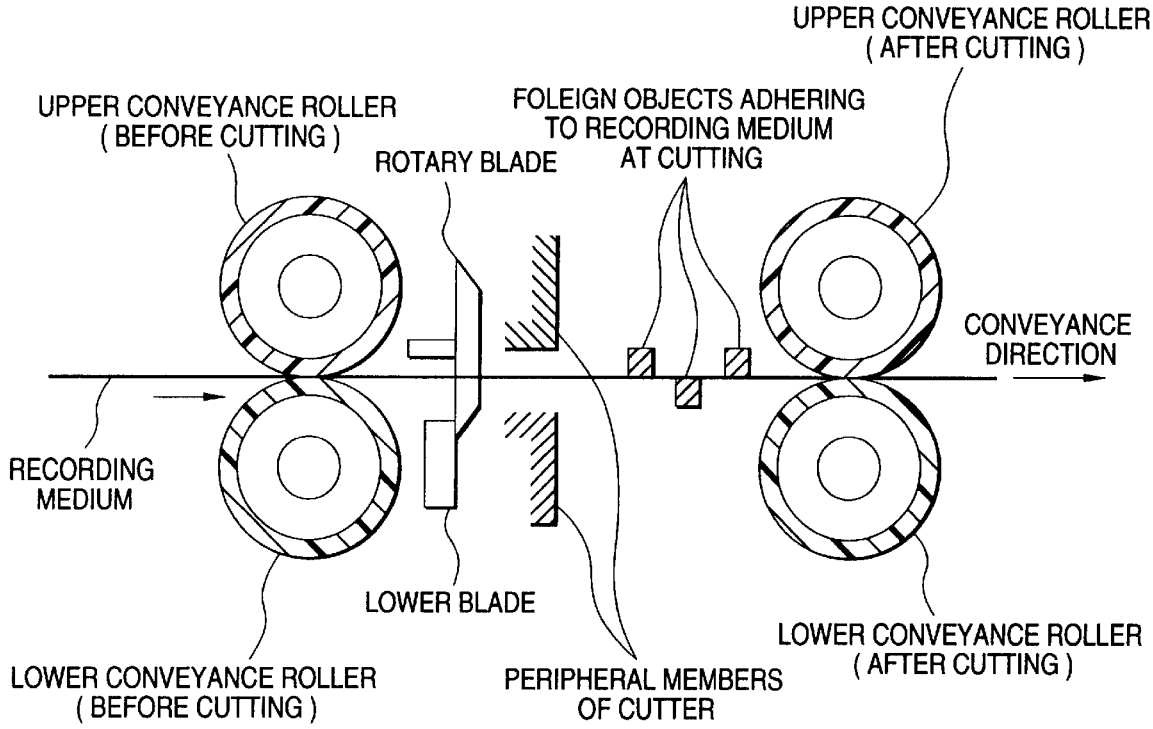
FIG. 12 is a schematic illustration showing a recording medium cutting section which is one of the specific sections of a recording apparatus to which an adhesive roller of a third embodiment of the present invention can be applied.
Figure 13:
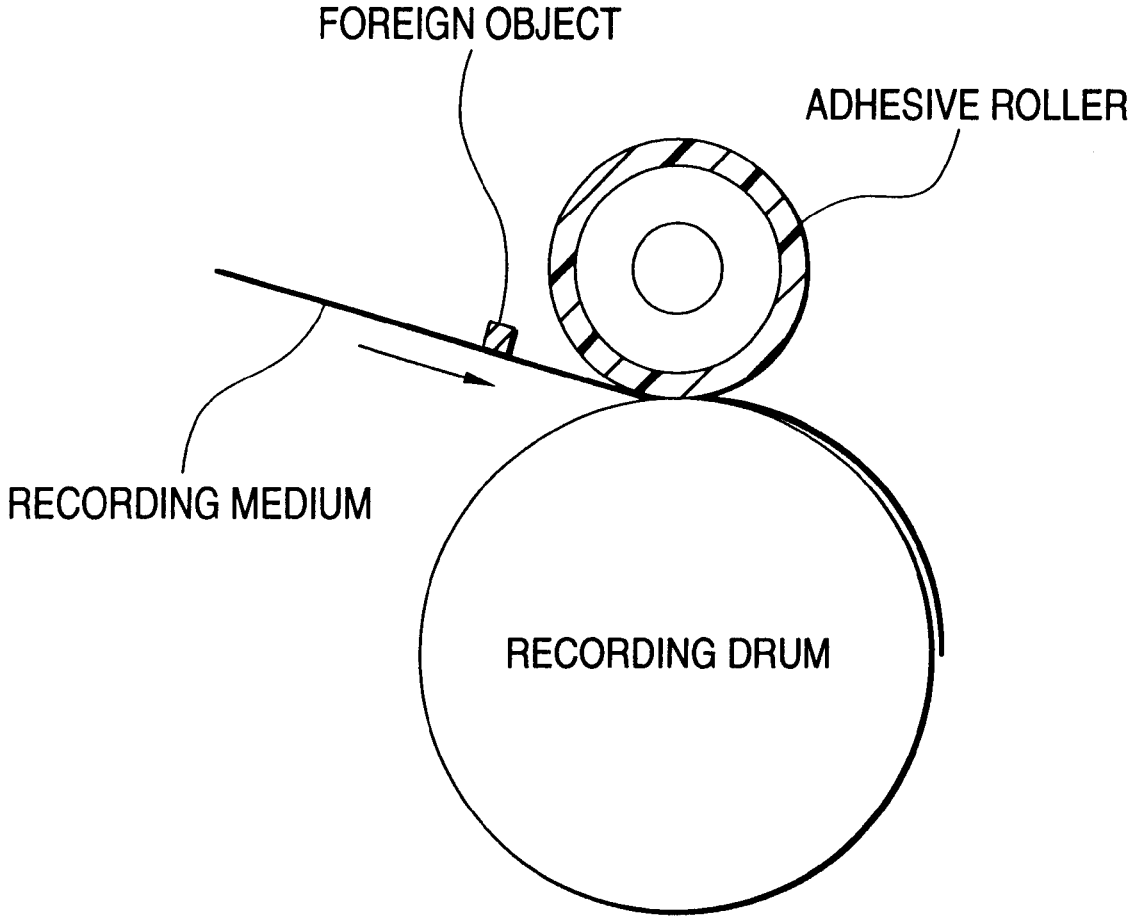
FIG. 13 is a schematic illustration showing a recording section (recording drum) which is one of the specific sections of a recording apparatus to which an adhesive roller of a fourth embodiment of the present invention can be applied.

FIG. 11 is a view showing a case in which foreign objects adhering to a recording medium in the recording medium conveyance section are removed by using an adhesive rubber roller of the second embodiment of the present invention. FIG. 12 is a view showing a case in which foreign objects adhering to a recording medium in the cutting section are removed by using an adhesive rubber roller of the second embodiment of the present invention. FIG. 13 is a view showing a case in which foreign objects adhering to a recording medium in the recording section (recording drum) are removed.

Figure 1:
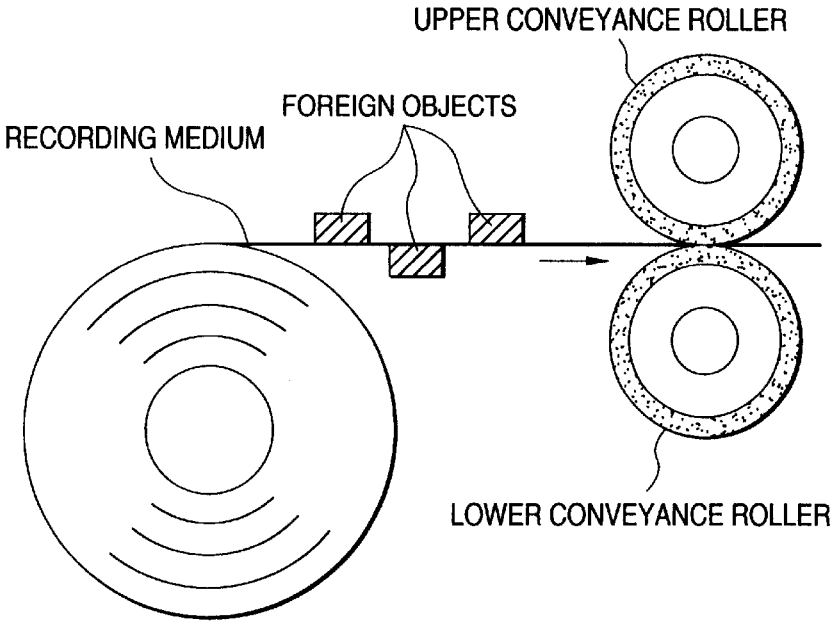
FIG. 1 is a schematic illustration explaining a case in which foreign objects adhering to a recording medium are removed.
Figure 2:
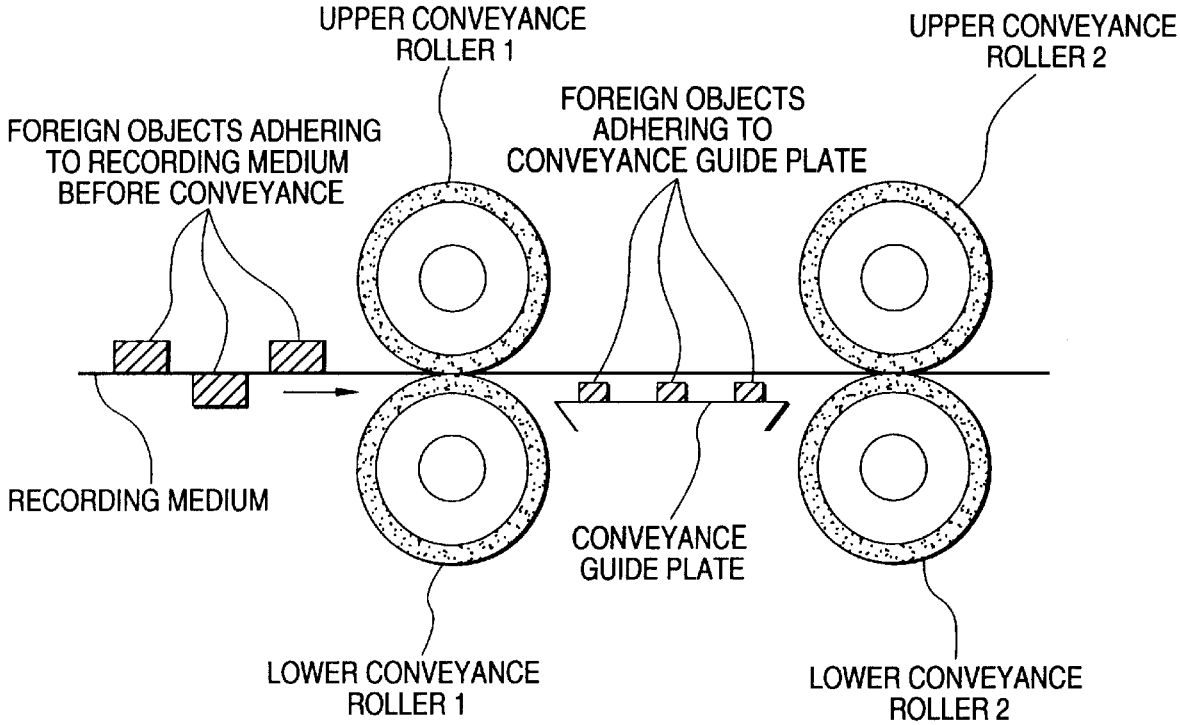
FIG. 2 is a schematic illustration explaining a case in which foreign objects adhering to a recording medium in a recording medium conveyance path during the conveyance are removed.
Figure 3:
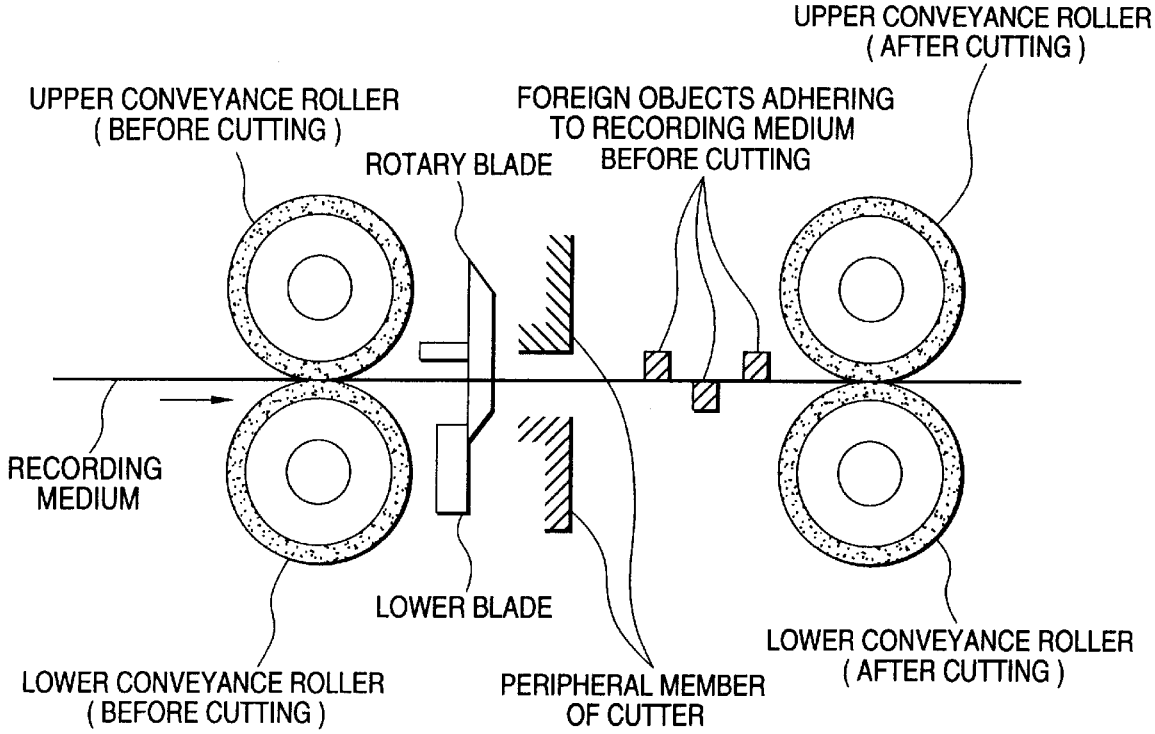
FIG. 3 is a schematic illustration explaining a case of removing chips which are generated from a recording medium and attached to the recording medium when the recording medium is cut with a cutter section.
Figure 4:
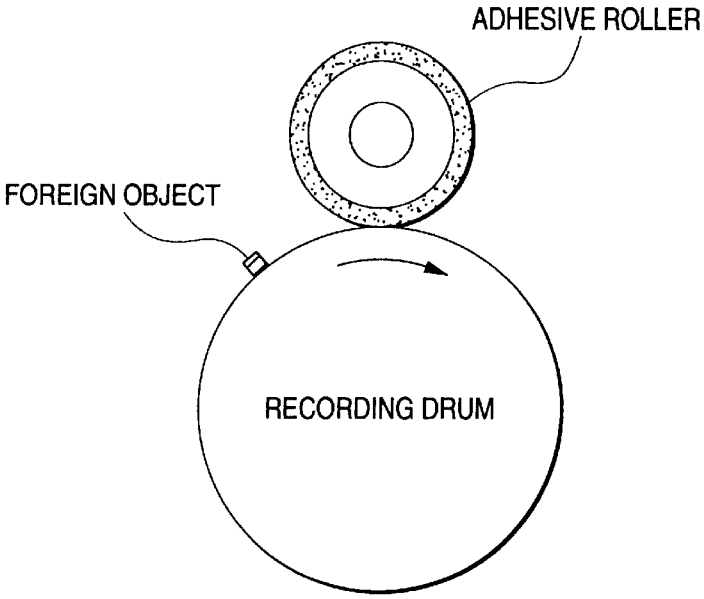
FIG. 4 is a schematic illustration explaining a case in which foreign objects adhering to a recording drum are removed.

Parts and functions shown in FIGS. 11 and 12 are the same as those shown in FIGS. 2 and 3. Therefore, the explanations of them are omitted here. FIGS. 11 and 12 are different from FIGS. 2 and 3 at the following point. That is, in the same manner as that shown in FIG. 10, at least one of the upper and the lower conveyance roller is an adhesive rubber roller, the composition of which is prescribed in the present invention.

Figure 5:
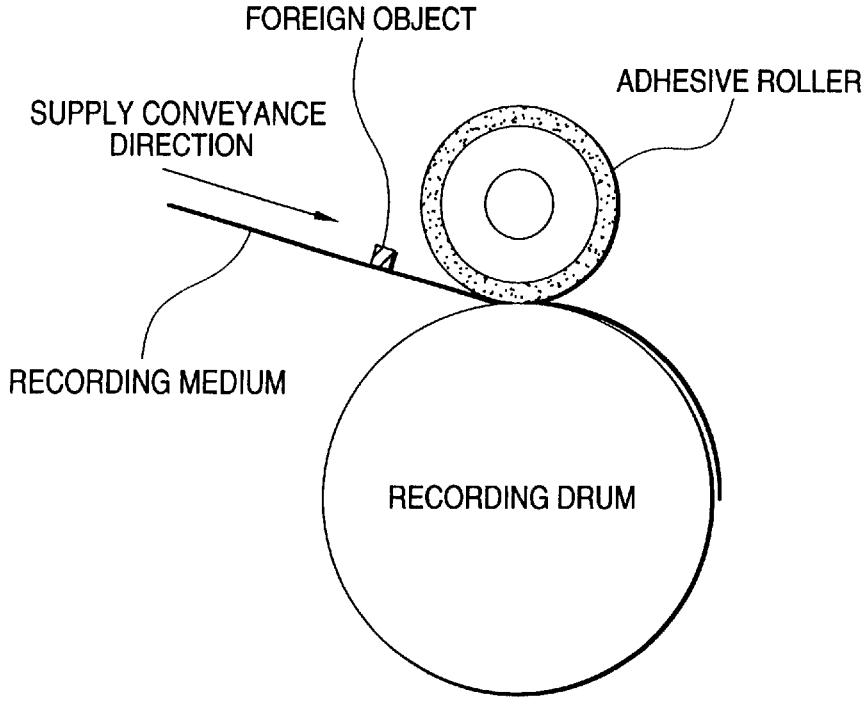
FIG. 5 is a schematic illustration explaining a case in which foreign objects adhering to a surface of a recording medium are removed during the conveyance of the recording medium to a recording drum.
Figure 6:
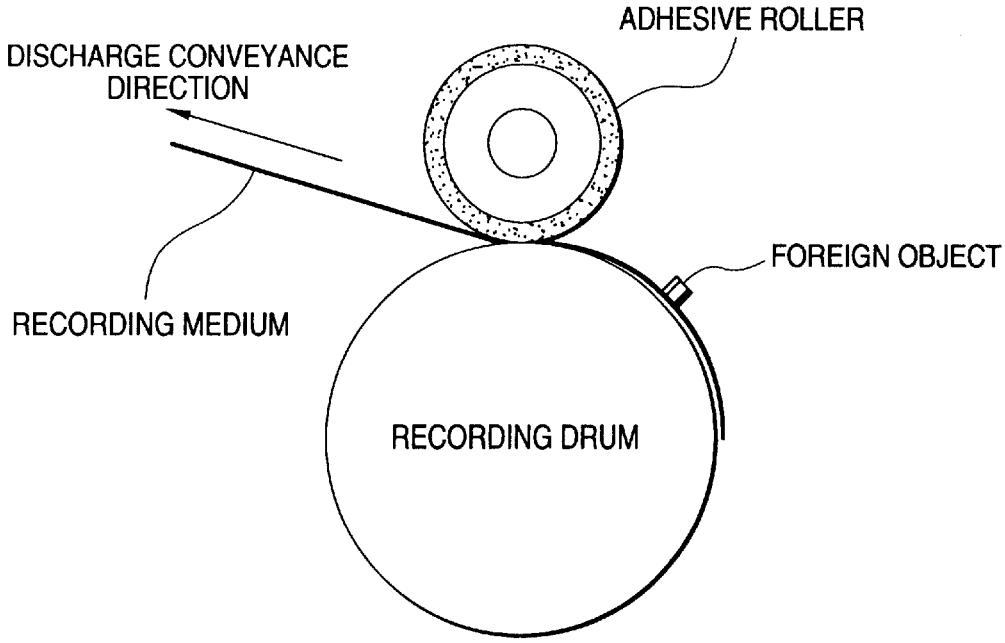
FIG. 6 is a schematic illustration explaining a case in which foreign objects adhering to a surface of a recording medium are removed during the conveyance of the recording medium from a recording drum.
Figure 7:
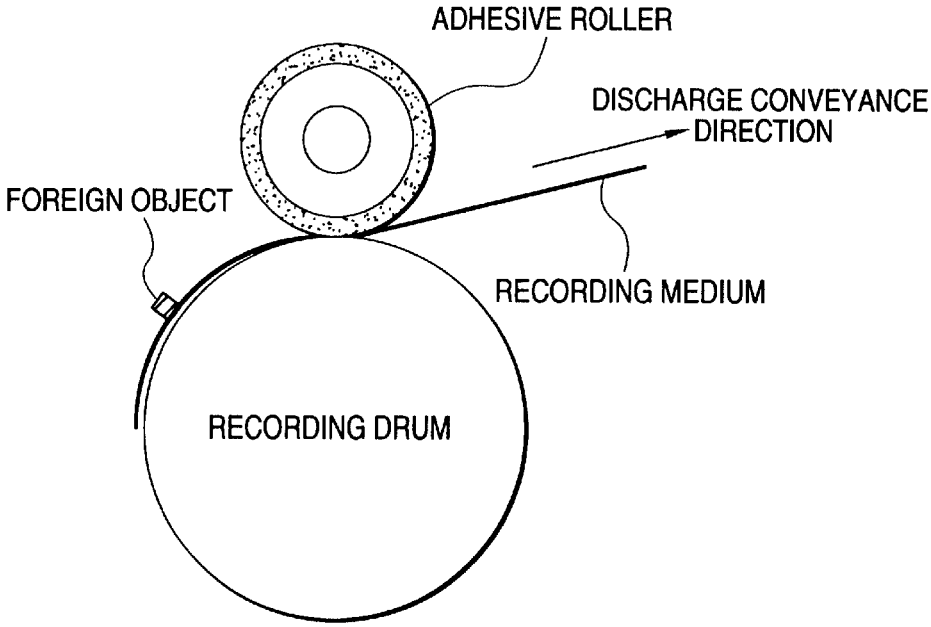
FIG. 7 is a schematic illustration explaining a case in which foreign objects adhering to a surface of a recording medium are removed during the conveyance of the recording medium from a recording drum.
Figure 8:
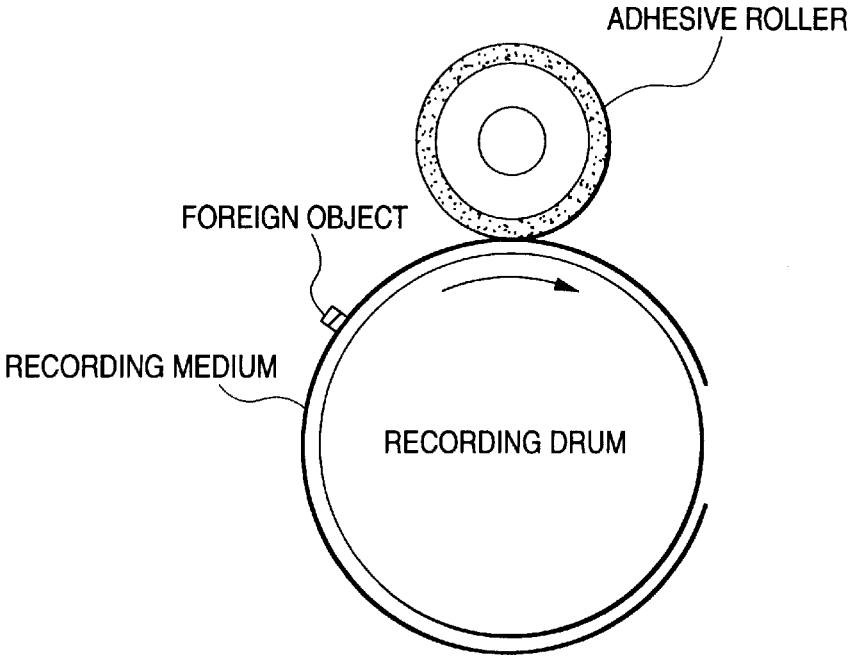
FIG. 8 is a schematic illustration explaining a case in which foreign objects adhering to a recording medium in the process of recording are removed.
Figure 9:
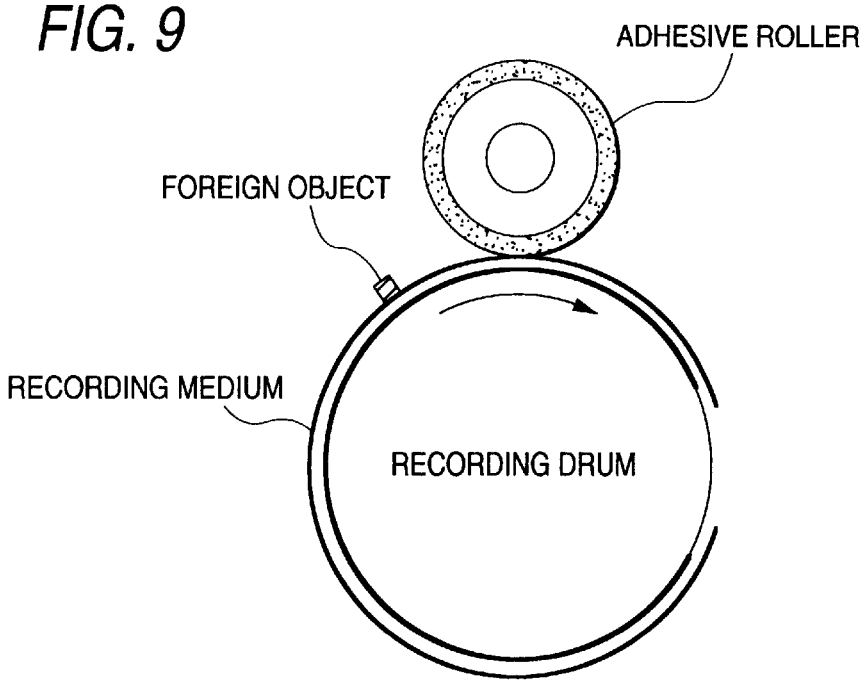
FIG. 9 is a schematic illustration explaining a case in which foreign objects adhering to a recording medium in the process of recording are removed.

FIG. 13 corresponds to FIG. 5 which represents the conventional method of removing foreign objects shown in FIGS. 4 to 9. FIG. 13 is different from FIG. 5 at the following points. That is, in the same manner as that explained in FIG. 10, the adhesive rubber roller, the composition of which is prescribed in the present invention, is used as an adhesive roller.

Although not shown in the drawing, it is possible to realize an embodiment of the present invention corresponding to each of the arrangements shown in FIGS. 4 to 9.

The rubber adhesive roller prescribed in the present invention contains $TiO_x$ (titanium oxide) and/or hydrocarbon compound having a functional group of C—O or Si—O and does not contain Ba barium as described before. A specific example of the adhesive rubber roller of the above composition is a rubber roller manufactured by Miyagawa Roller K. K., the brand name of which is "Carboless MIMOSA" of grade LT or ST, the performance of which is shown on Table 1.

TABLE 1

| Grade | LT | ST |
|---|---|---|
| Adhesive force [hPa] | 27 | 62 |
| Hardness [°] (JIS A) | 35 | 25 |
| Electric resistance [Ω] | $4 \times 10^7$ | $8 \times 10^7$ |

On Table 1, the adhesive force, hardness and electric resistance are respectively shown with respect to "Carboless MIMOSA" of grade LT", which is expressed by "LT" on Table 1, and "Carboless MIMOSA" of grade ST", which is expressed by "ST" on Table 1.

The above rubber roller is characterized in that the electric resistance is low, so that static electricity generated in a recording medium can be removed.

A test of removing foreign objects, the performance of which deteriorates with time, was conducted on "Carboless MIMOSA" of grade ST", "Carboless MIMOSA" of grade LT", "MIMOSA Under LT" and "Cleaner Green". The result of the test to remove foreign objects is shown on FIG. 14.

Figure 14:
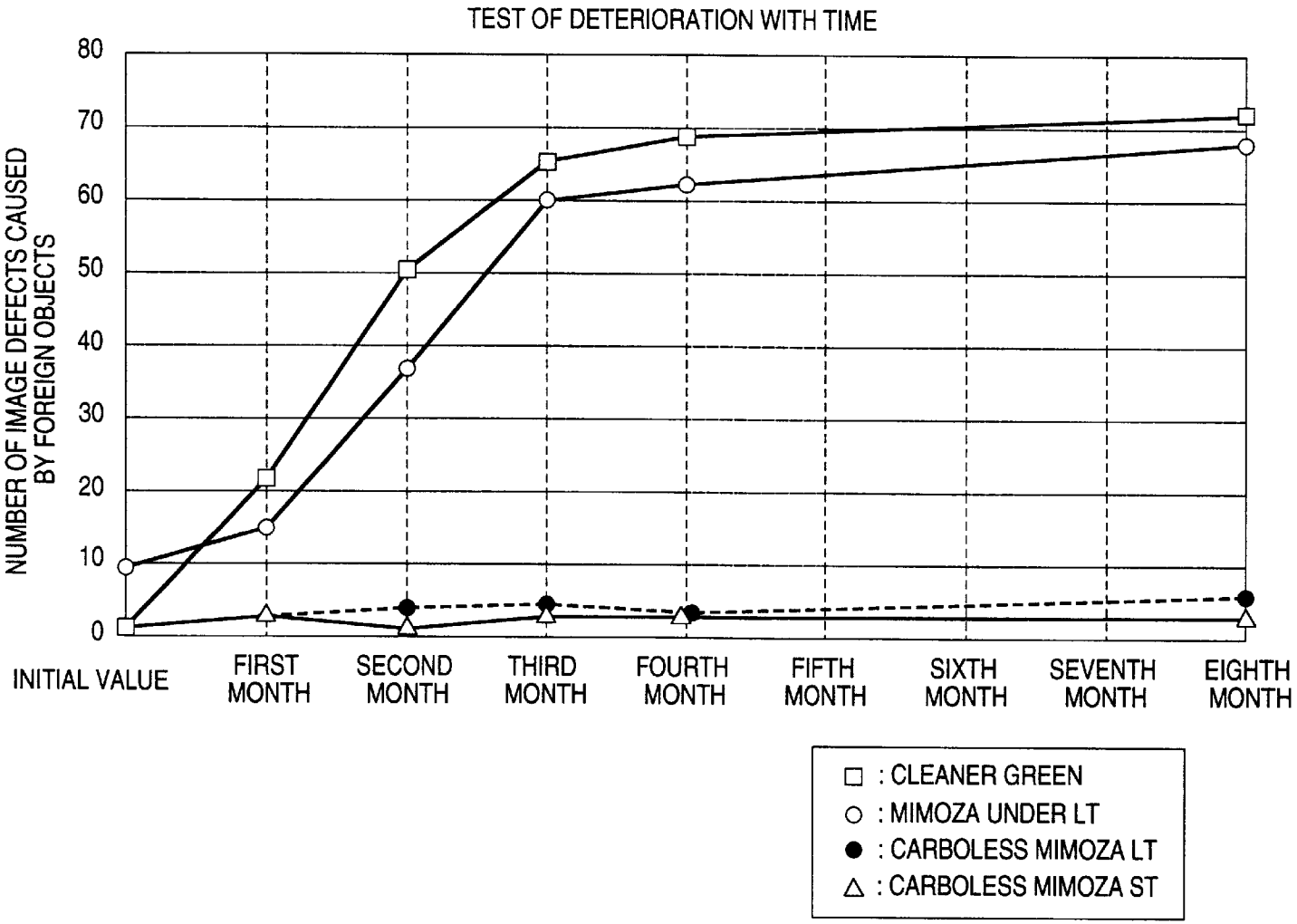
FIG. 14 is a view showing a result of the comparison of the effect of removing foreign objects by "Carboless MIMOSA ST", "MIMOSA Under LT" and others.
Figure 15:
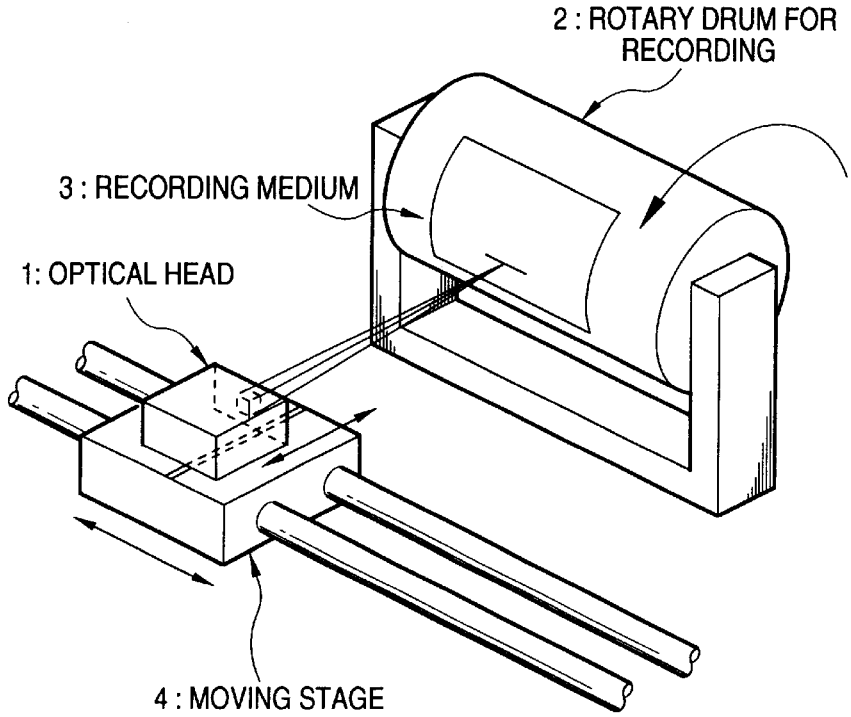
FIG. 15 is a perspective view showing a primary portion of a recording section of a recording apparatus.
Figure 16:
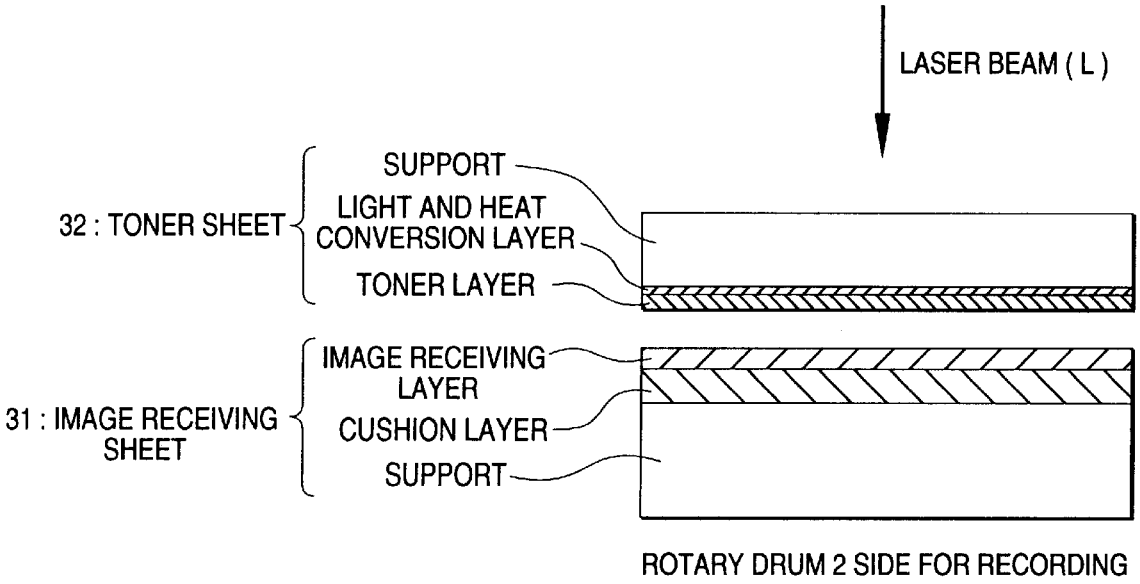
FIG. 16 is a view showing the structure of an image receiving sheet and a toner sheet composing the recording medium shown in FIG. 15.
Figure 17A:
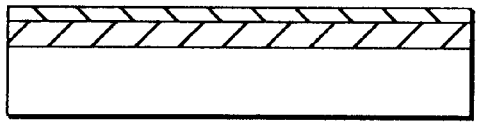
FIGS. 17(*a*) to 17(*f*) are views showing a common procedure of specific color image recording.
Figure 17B:
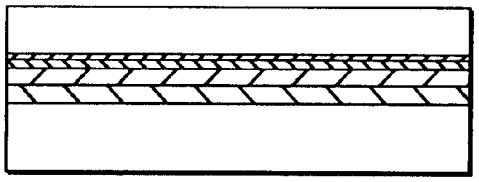
Figure 17C:
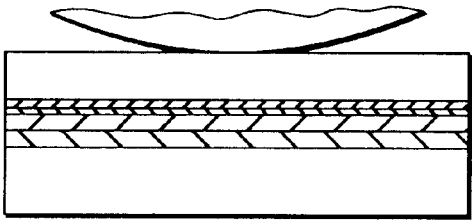
Figure 17C:
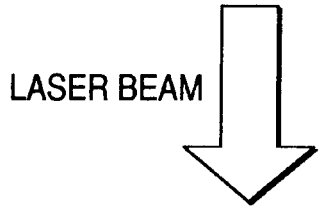
Figure 17D:
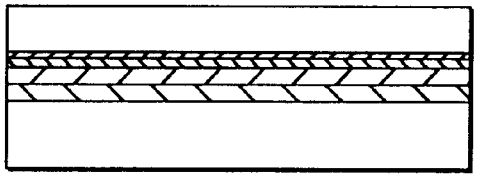
Figure 17E:
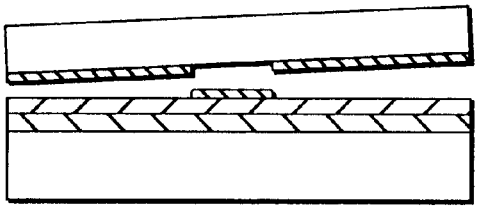
Figure 17F:
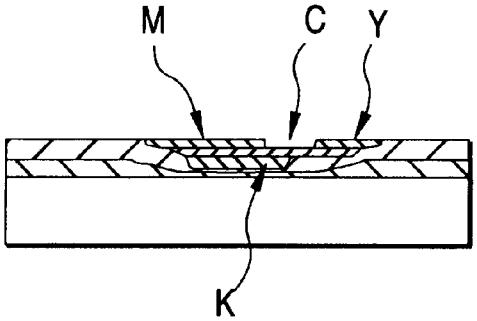
Figure 18:
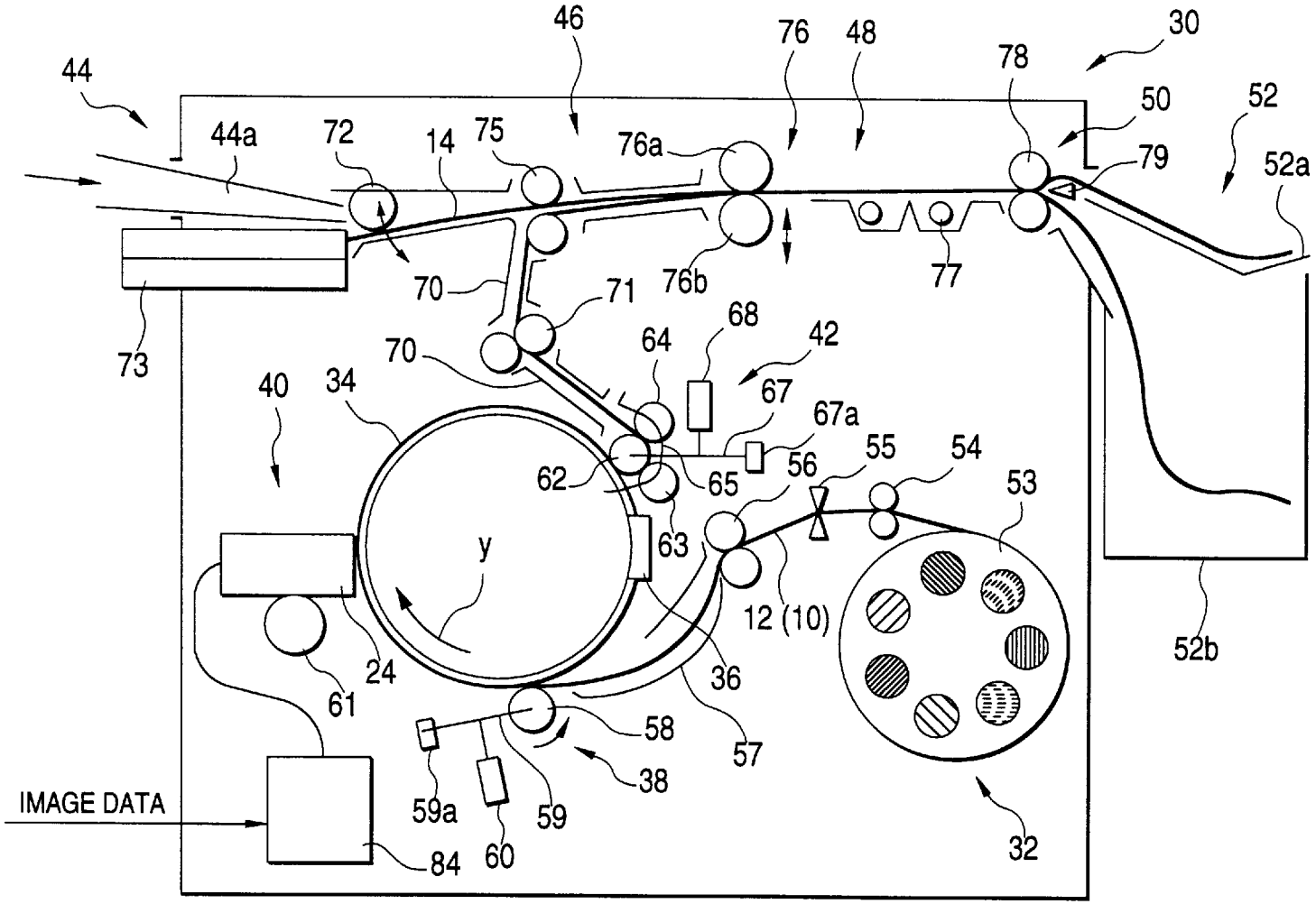
FIG. 18 is an overall arrangement view of a recording apparatus used in the present invention.

The graph shown on FIG. 14 shows a result of the test in which the adhesive rubber roller was left for one month while it was not used in this period, and it was used after one month and the number of image defects caused by foreign objects was counted. On the graph, the horizontal axis represents the number of months and the vertical axis represents the number of image defects caused by foreign objects.

According to the graph shown in the drawing, in the cases of "Carboless MIMOSA" of grade ST" and "Carboless MIMOSA" of grade LT", even after 8 months had passed, the number of image defects caused by foreign objects was smaller than 10. However, in the case of "MIMOSA Under LT", after one month had passed, the number of image defects exceeded 10 (the number of image defects=15). After 2 months had passed, the number of image defects was 36. After 3 months had passed, the number of image defects was 60. After 8 months had passed, the number of image defects was close to 70. In the case of "Cleaner Green", after one month had passed, the number of image defects exceeded 20. After 2 months had passed, the number of image defects was 50. After 3 months had passed, the number of image defects was 67. After 8 months had passed, the number of image defects exceeded 70.

As described above, even when the same adhesive rubber roller was used, a big difference was caused.

Table 2 shows a result of comparison of the rubber quality and the integrated performance of "Carboless MIMOSA" of grade ST", "Carboless MIMOSA" of grade LT", "Cleaner Green" and "Under LT".

TABLE 2

| | Name of adhesive rubber | Rubber polymer | Filler | Plasticizer | Conveyance property | Capacity of removing foreign objects | Deterioration of adhesive force with time | Adhesive force Hpa |
|---|---|---|---|---|---|---|---|---|
| Example 1 | Carboless MIMOSA ST | Isobutylene (polymer of isobutylene) or Isobutylene (polymer of isobutylene) | $SiO_2$ $TiO_2$ $ZnO_2$ | Paraffin Hydrocarbon compound or hydrocarbon compound having a functional group of C—O or Si—O | ○ | ○ | ○ | 62 |
| Example 2 | Carboless MIMOSA LT | | $SiO_2$ $TiO_2$ $ZnO_2$ | | ○ | ○ | ○ | 27 |
| Comparative Example 1 | Cleaner Green | | $SiO_2$ $BaSO_2$ $ZnO_2$ | Paraffin | X *1 | ○ | X | 70 |
| Comparative Example 2 | Under LT | — | — | — | ○ | X *2 | X | 8 |

*1: The adhesive force is so strong that the image receiving layer is peeled off and the recording medium is wound.
*2: The adhesive force is so weak that foreign object can not be sufficiently removed.

Due to the foregoing, it can be understood that the adhesive rubber roller made of adhesive rubber such as "Carboless MIMOSA ST" and "Carboless MIMOSA LT", which contains $TiO_x$ (titanium oxide) as filler and also contains hydrocarbon having a functional group of C—O or Si—O as plasticizer, is most appropriate because the conveyance property is excellent and the adhesive force is seldom deteriorated with time.

On the contrary, when the adhesive rubber roller made of rubber containing Ba (barium) is used, the conveyance property is not excellent and further the adhesive force deteriorates with time. Accordingly, it can be understood that the adhesive rubber roller containing Ba (barium) is not appropriate to remove foreign objects from the recording apparatus.

When the adhesive rubber roller, the composition of which is described above, is used as at least one of the rollers of the recording apparatus, it becomes possible to remove foreign objects from the surface of the recording medium or the inside of the recording apparatus.

The adhesive rubber roller of the present invention can be applied to a recording apparatus in which the rotation of the rotary drum is used as high speed scanning (primary scanning) and the movement of the optical head in the axial direction of the rotary drum is used as low speed scanning (auxiliary scanning).

As explained above, according to the present invention, an adhesive rubber roller made of rubber, the filler of which is $TiO_x$ (titanium oxide) and the plasticizer of which is hydrocarbon having a functional group of C—O or Si—O, is used for at least one of the recording medium supply section, recording medium conveyance section, recording medium cutting section and recording section. Therefore, the adhesive force of rubber itself is seldom changed with time. Accordingly, the adhesive effect can be kept over a long period of time. As a result, it is possible to remove foreign objects from a recording medium over a long period of time. Therefore, it is possible to form images, on which no defects are caused by foreign objects, over a long period of time.

Further, these roller can be applicable to each section of the recording apparatus as an added auxiliary roller for removing foreign objects from a recording medium.

Accordingly, it is unnecessary to conduct maintenance of the recording apparatus over a long period of time. Therefore, it is possible to accomplish an object of "maintenance-free" depending upon the frequency of use.

What is claimed is:

1. A recording apparatus comprising:

a recording medium supply section;

a recording medium conveyance section;

a recording medium cutting section;

a recording section; and at least one adhesive rubber roller made of a material containing $TiO_x$ (titanium oxide), said at least one adhesive rubber roller being correspondingly used in at least one of said sections.

2. A recording apparatus according to the claim 1, wherein the material is free from Ba (barium).

3. A recording apparatus according to the claim 1, wherein the material further contains hydrocarbon compound having a functional group of C—O or Si—O.

4. A recording apparatus according to the claim 3, wherein the material is free from Ba (barium).

5. A recording apparatus according to the claim 1, wherein high speed scanning (primary scanning) is conducted by rotation of a rotary drum, and low speed scanning (auxiliary scanning) is conducted by movement of an optical head in the axial direction of the rotary drum.

6. A recording apparatus comprising:

a recording medium supply section;

a recording medium conveyance section;

a recording medium cutting section;

a recording section; and at least one adhesive rubber roller made of a material containing hydrocarbon compound having a functional group of C—O or Si—O, said at least one adhesive rubber roller being correspondingly used in at least one of said sections.

7. A recording apparatus according to the claim 6, wherein the material is free from Ba (barium).

8. A method of removing foreign objects applied to a recording apparatus having a recording medium supply section, a recording medium conveyance section, a recording medium cutting section and a recording section, the method comprising removing foreign objects from one of a surface of a recording medium and an inside of the recording apparatus by using an adhesive rubber roller made of a material containing $TiO_x$ (titanium oxide), said removing being performed in at least one of said sections.

9. A method of removing foreign objects according to the claim 8, wherein the material is free from Ba (barium).

10. A method of removing foreign objects according to the claim 8, wherein the material further contains hydrocarbon compound having a functional group of C—O or Si—O.

11. A method of removing foreign objects according to the claim 10, wherein the material is free from Ba (barium).

12. A method of removing foreign objects according to the claim 8, wherein high speed scanning (primary scanning) is conducted by rotation of a rotary drum, and low speed scanning (auxiliary scanning) is conducted by movement of an optical head in the axial direction of the rotary drum.

13. A method of removing foreign objects from a recording apparatus having a recording medium supply section, a recording medium conveyance section, a recording medium cutting section and a recording section, the method comprising removing foreign objects from a surface of a recording medium or the inside of the recording apparatus by using an adhesive rubber roller made of a material containing hydrocarbon compound having a functional group of C—O or Si—O, said removing being performed in at least one of said sections.

14. A method of removing foreign objects according to the claim 13, wherein the material is free from Ba (barium).

* * * * *